United States Patent [19]

Tremain et al.

[11] 4,060,341

[45] Nov. 29, 1977

[54] AUTOMATIC AUXILIARY JET SUMP PUMP

[75] Inventors: David L. Tremain, Sterling; Burt L. Beach; James C. Hadley, both of Prophetstown, all of Ill.

[73] Assignee: Houdaille Industries, Inc., Buffalo, N.Y.

[21] Appl. No.: 614,795

[22] Filed: Sept. 19, 1975

Related U.S. Application Data

[63] Continuation-in-part of Ser. No. 529,804, Dec. 5, 1974, abandoned.

[51] Int. Cl.[2] ..... F04F 5/48

[52] U.S. Cl. ..... 417/182.5; 417/89

[58] Field of Search ..... 417/82, 87, 89, 85, 417/211.5, 426, 182.5

[56] References Cited

U.S. PATENT DOCUMENTS

| | | | |
|---|---|---|---|
| 424,553 | 4/1890 | Hoffman | 417/182.5 |
| 1,063,468 | 6/1913 | Pribil | 417/182.5 |
| 1,133,040 | 3/1915 | Koerting | 417/182.5 X |
| 3,472,172 | 10/1969 | Vignerot | 417/182.5 |

*Primary Examiner*—William L. Freeh
*Assistant Examiner*—Edward Look
*Attorney, Agent, or Firm*—Fitch, Even, Tabin & Luedeka

[57] ABSTRACT

An auxiliary jet sump pump, particularly for use with a main conventional electrical sump pump or the like, as a substitute pump in the event the main pump is inoperative, or as a supplemental pump in the event the capacity of the main pump is exceeded. The auxiliary pump is adapted to be mounted in the sump, and discharges into the discharge pipe of the main pump. The auxiliary pump is powered by water under pressure, for example water from the usual municipal water supply. A float-actuated valve is provided which admits water into the auxiliary pump when the water level in the sump rises to a first predetermined level above normal, and which shuts off the water when the water level reaches a second predetermined level lower than the first predetermined level.

14 Claims, 7 Drawing Figures

Fig. 1
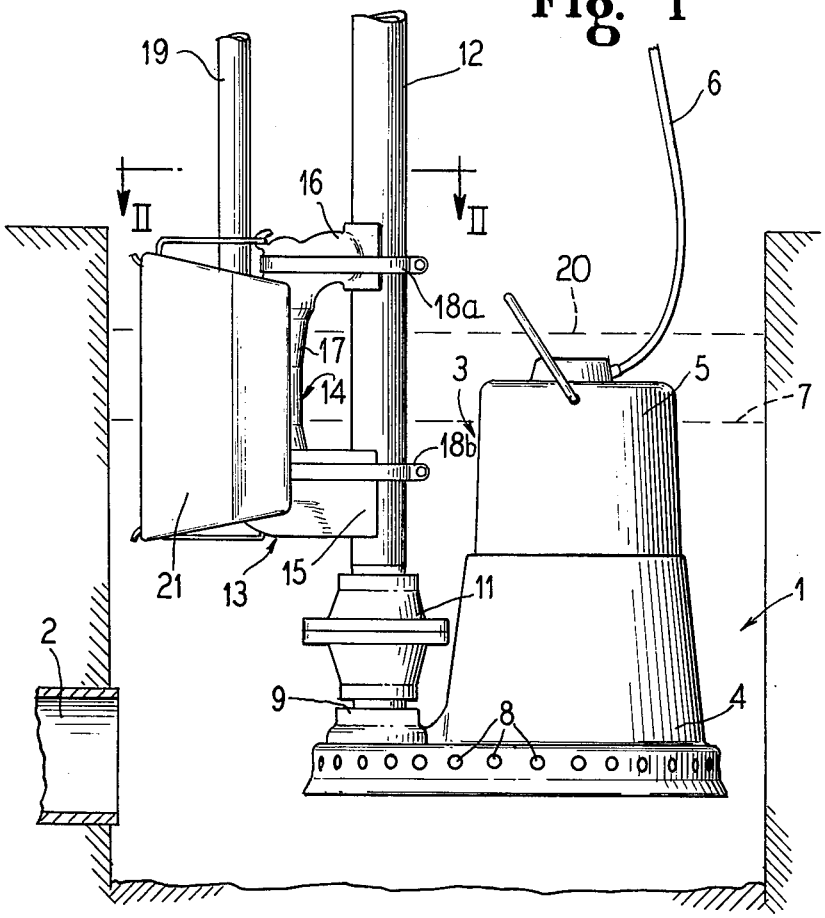
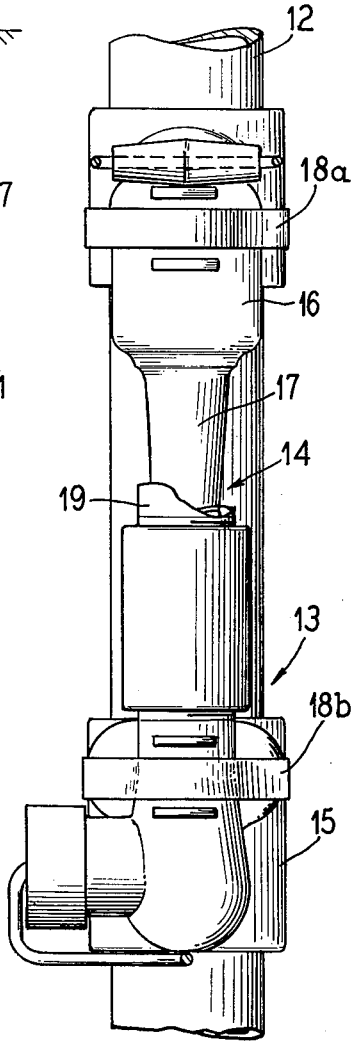
Fig. 4
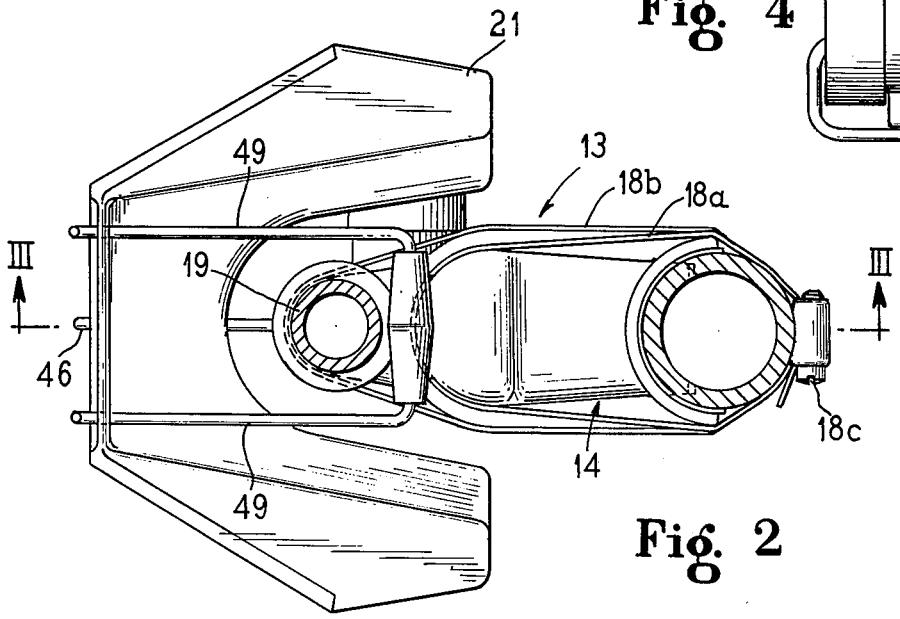
Fig. 2

Fig. 3
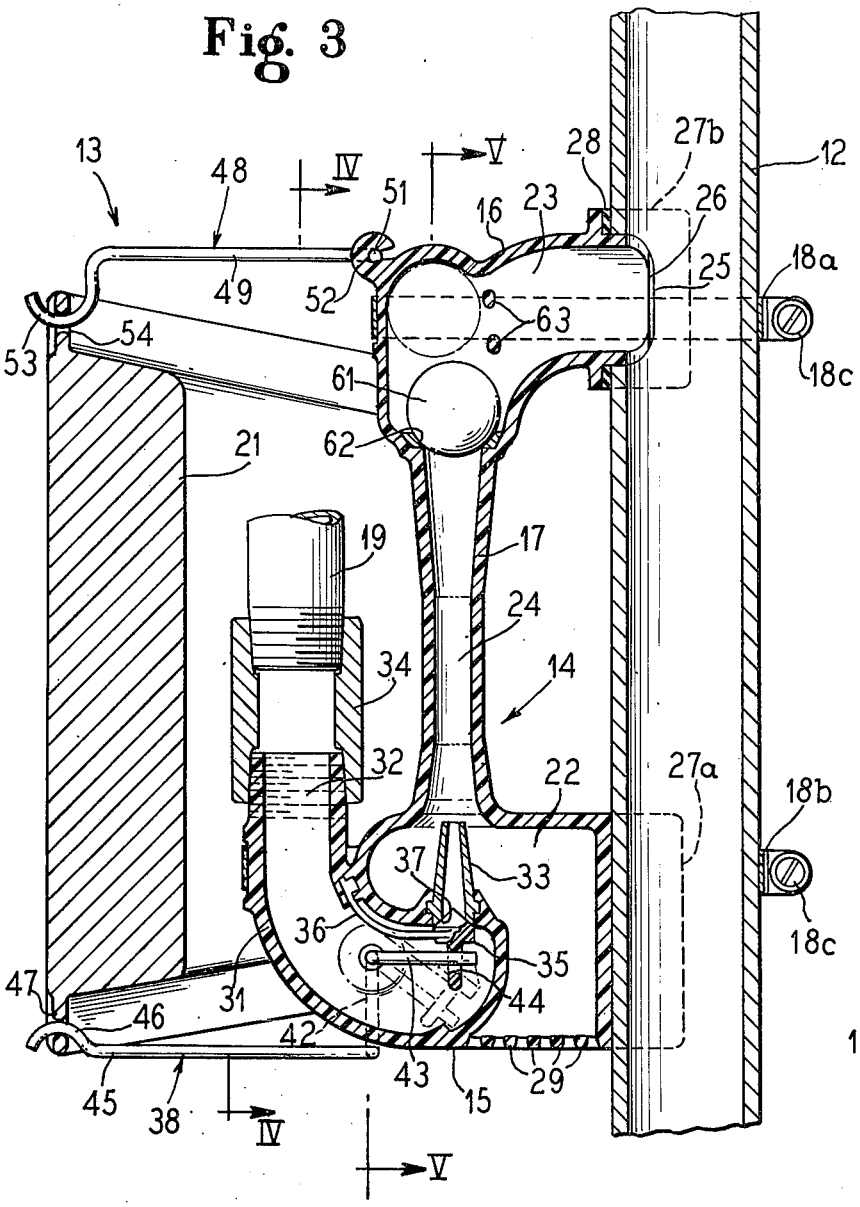
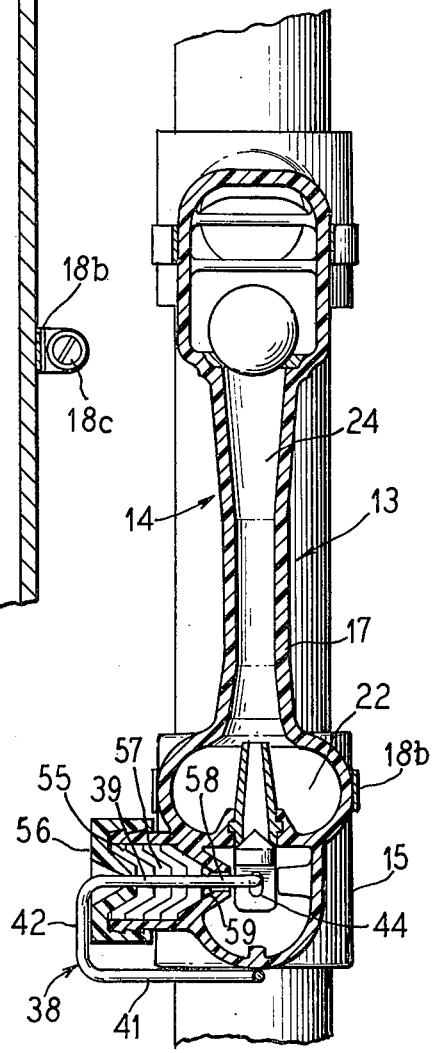
Fig. 5

AUTOMATIC AUXILIARY JET SUMP PUMP

BACKGROUND OF THE INVENTION

The present invention is directed to a hydraulic or jet-type pump, adapted to be substituted for or supplement a conventional electrical sump pump or the like. This application is a continuation-in-part of application Ser. No. 529,804, now abandoned filed Dec. 5, 1974.

Electrical sump pumps are extensively used both industrially and in homes and other residential buildings where a possibility of water seepage or flooding exists. It is customary, for example, in home building, to run a drain tile around the perimeter of the building and to connect such tile to a relatively small sump, for example 18 inches to 2 ft. in diameter, and several feet deep, in which is disposed a suitable pump driven by an electric motor, for example a submersible type centrifugal pump. The submersible pump is disposed adjacent the bottom of the sump and pumps water from the sump to or above grade level through a discharge pipe extending through the house wall or foundation to a point outside the house. A check valve is often provided in the discharge line adjacent the pump to prevent back flow through the pump.

Oftentimes, however, a rainstorm which results in rapid buildup of water in the sump also causes a disruption in power distribution so that when the sump pump is most needed there is no electrical power to drive it. Moreover, under extreme conditions it sometimes is possible that the volume of water entering the sump may be so great, for example under flood conditions or the like, that the sump pump is incapable of handling the load.

Under both such conditions it would be particularly desirable to have an auxiliary sump pump, capable of supplementing the main sump pump or in the event of inoperation of the latter of substituting therefor, and to make an auxiliary pump effective under both conditions, it preferably should be operated by some power source other than electricity.

BRIEF SUMMARY OF THE INVENTION

The present invention is directed to an auxiliary sump pump which is hydraulically powered, as for example by water under pressure from the usual municipal water supply system. A municipal water supply system normally will be operative even in severe storms or the like which result in an electric power outage. The auxiliary sump of the present invention pump may be readily disposed in a sump, along with the main sump pump, and in the embodiments herein discribed it is mounted on the discharge pipe of the latter. The auxiliary sump pump is automatically actuated so that when the water in the sump reaches a first predetermined level, higher than the normal maximum level, the auxiliary sump pump will be actuated to either supplement the output of the main sump pump or to substitute entirely for the main sump pump if the latter is inoperative. Automatic actuation is provided by a float-controlled valve which opens when the float reaches the predetermined level, thereby admitting water into the auxiliary sump pump to provide power therefor. When the water level in the sump reaches a second predetermined level lower than the first predetermined level, the float causes the valve to close, shutting off the flow of water to the auxiliary pump. Both the main pump and the auxiliary pump are provided with check valves disposed in their discharge sides to prevent backflow therethrough. The auxiliary pump may be readily installed on existing sump pump installations, and is adapted to be fabricated in large part from suitable plastic materials to decrease its cost.

BRIEF DESCRIPTION OF THE DRAWINGS

In the drawings wherein like reference characters indicate like or corresponding parts:

FIG. 1 is a sectional view through a portion of a sump in which a first embodiment of the auxiliary sump pump of the present invention is installed;

FIG. 2 is a sectional view taken approximately on the line II—II of FIG. 1 with the auxiliary sump pump being illustrated in plan;

FIG. 3 is a sectional view taken approximately on the line III—III of FIG. 2;

FIG. 4 is a sectional view taken approximately on the line IV—IV of FIG. 3;

FIG. 5 is a sectional view taken approximately on the line V—V of FIG. 3;

DETAILED DESCRIPTION OF THE INVENTION

General

Figure 6:
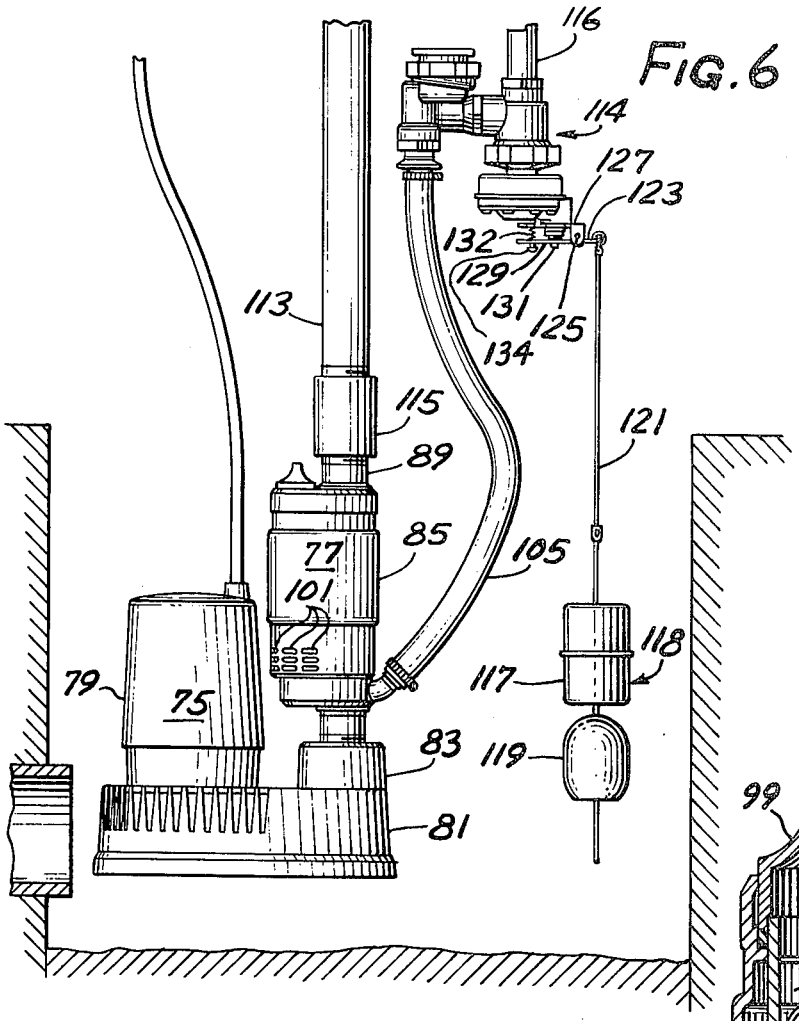
FIG. 6 is a sectional view through a portion of a sump in which a second embodiment of the auxiliary sump pump of the present invention is installed.

Referring to the drawings and more particularly to FIG. 1, reference numeral 1 indicates generally a sump having a water inlet 2. Disposed in the sump 1 is a main sump pump, indicated generally by the numeral 3, illustrated as being of the submersible type. The main sump pump has a body 4 in which is housed the impeller or other pump mechanism (not illustrated), adapted to be driven by an electric motor 5 connected with an electrical power source by a power line 6. Means for automatically energizing the motor are also provided, although not illustrated, when the water in the sump reaches a predetermined level as for example the level 7. The pump is provided with a plurality of inlet openings 8 in the base thereof and is provided with a discharge fitting 9 to which is attached a check valve 11, the outlet side of which is connected with a discharge pipe 12. The construction thus far described is typical of most sump installations employing a submersible pump.

Also disposed in the sump 1, and illustrated as being mounted on the pipe 12, is an auxiliary sump pump indicated generally by the numeral 13, which is of the jet type, as hereinafter described in greater detail, and comprises a body, indicated generally by the numeral 14, having vertically spaced pipe-engaging members 15 and 16 which are connected by an intermediate portion 17. The pipe engaging members 15 and 16 are firmly secured to the pipe by suitable means which in the embodiment illustrated comprises respective bands 18*b* and 18*a*, which encircle the pipe 12 and adjacent portions of the pump structure.

The pump 13 is of the jet type powered by water under pressure, which in the embodiment illustrated is supplied by means of a pipe 19. As hereinafter described in detail, the flow of water from the supply pipe 19 into the auxiliary pump 13 is controlled by valve means actuated by a float member 21. In operation, the float member 21 is so disposed that in the event the water level reaches an abnormally undesired height in the sump 1, for example the level 20, either as a result of failure of the main pump 3 to operate or an abnormally high volume of incoming water, the float 21 will open the valve means permitting water under pressure to flow into the pump 13 and thence into the discharge pipe 12.

To prevent a reverse flow through the auxiliary pump 13 during normal operation of the main pump 3, the auxiliary pump 13 is provided with a check valve. Likewise, in the event the main pump 3 is inoperative the check valve 11 will prevent a reverse flow therethrough during operation of the auxiliary pump 13.

Referring to FIGS. 2–5, the lower pipe-engaging member 15 defines a water inlet chamber 22, while the upper pipe-engaging member 16 defines a water discharge chamber 23, with such chambers being in fluid communication through a venturi passageway 24 in the intermediate portion 17 of the body 14. The discharge chamber 23 is in fluid communication with the interior of the discharge pipe 12 of the main pump 3, such pipe being provided with an opening 25 therein adapted to receive the open end portion 26 of the upper member 16 which is also provided with a semicircular, integrally formed flange 27*b* which abuts the external periphery of the pipe 12 at the opening 25 with the joint therebetween being sealed by a gasket member 28 which is compressed by the action of the clamp 18*a*, thus forming an effective fluid seal at the junction of the pipe 12 and the end 26. The lower member 15 is also provided with a semicircular flange 27*a*, likewise engageable with the pipe 12.

The intake chamber 22 is in fluid communication with the sump 1 through suitable intake openings 29 in the bottom wall of the member 15, such openings preferably being formed to effectively function as a screen to prevent undesired material or debris from entering the pump.

The lower member 15 is provided with a water supply fitting 31, the interior 32 of which is in fluid communication with the chamber 22 adjacent the mouth of the venturi passageway 24 through a nozzle 33, the supply pipe 19 being suitably connected to the fitting 31 as for example by means of a suitable pipe coupling 34 or the like.

The discharge of water under pressure through the nozzle 33 is controlled by a movable valve member 35, illustrated as being supported by a suitable flexible or resilient member 36, secured at one end to the valve member 35 and at the other to an adjacent portion of the pump structure, the member 36 preferably being so designed that it offers a minimum resistance to movement of the valve member 35 but will maintain the latter in proper orientation with respect to the valve seat 37, illustrated as being formed on the lower end of the nozzle 33, as viewed in FIG. 3.

As shown in FIG. 5, the valve member 35 is moved to and from its open and closed positions by an actuating member 38 which has a generally bell-crank configuration and comprises a generally U-shaped structure, consisting of a pair of parallel leg portions 39 and 41 connected by an intermediate portion 42. The free end of the leg portion 39 terminates in an actuating lever 43 (FIG. 3), disposed at a substantially 90° angle with respect to the portion 39, and the free end of the lever 43 extends through an elongated opening 44 in the lower portion of the valve member 35. In like manner, extending from the free-end of the portion 41, but in opposite direction with respect to that of the lever 43, is an actuating arm 45, the free end of which is provided with a more or less hook-like portion 46, extending through an opening 47 in the bottom portion of the float 21. The upper portion of the float 21 is maintained in suitable relation by a U-shaped bail member 48 having a pair of leg portions 49 connected by an intermediate portion 51, the latter being suitably pivotally supported in a tubular extension 52, integrally formed on the upper member 16. The free ends of the leg portions 49 are each provided with a hook portion 53, which extend through respective openings 54 formed in the float 21.

As illustrated in FIG. 5, the actuating member 38 is pivotally supported from the leg portion 39 which extends through a packing chamber 55, closed at its outer end by a packing nut 56, and containing a plurality of packing elements 57, with the inner end of the leg being effectively sealed, with respect to the adjacent wall 58 of the lower chamber, by an O-ring 59.

Disposed in the discharge chamber 23 is a ball 61 which is received in a valve seat 62, formed from a suitable material, with the ball 61 thus forming a check valve preventing flow of liquid downwardly through the venturi passageway 24, when the main sump pump 3 is in operation. The ball 61 may readily move upwardly under the action of water flow upwardly through the venturi passageway 24, for example to a position such as illustrated in dashed lines in FIG. 3, thereby fully opening the check valve. Suitable retaining rods or bars 63 may be provided to prevent excessive movement of the ball 61 in the discharge chamber.

The entire body 14, including the lower and upper members 15, 16 and intermediate member 17, as well as the fitting 31, may all be suitably fabricated from plastic or the like. The body may be formed from a plurality of components, as for example two mating halves, with their juncture falling approximately on the section line of FIG. 3, to facilitate installation of the remaining elements, as for example the actuating member 38. As illustrated, the nozzle 33 is fabricated as a separate element and mounted in sealing relation in the adjacent portions of the body structure whereby both the nozzle 33 and the valve member 35 may be formed of desired materials other than the plastic of the body structure. The various components may be assembled, and the plastic elements united by means of solvent welding or the like, to produce an integral unitary body structure having more than adequate strength for the functions involved.

The auxiliary pump structure described may be readily applied to existing structures, as well as new installations, by a few very simple operations. The height at which the water level height in the sump at which the auxiliary pump is to be actuated is determined and the auxiliary pump is mounted on the pipe 12 at the corresponding elevation. The location of the upper member 16 with respect to the pipe 12 is then determined and the latter is suitably cut to provide opening 25, of suitable shape. This can readily be achieved, by the employment of suitable hand or power tools. The pump is then positioned on the pipe, as illustrated in FIG. 3, with the gasket 28 in proper position and clamps 18*a* and 18*b* applied to rigidly clamp the pump structure to the pipe 12. As illustrated, the clamps 18*a* and 18*b* may be of the type commonly used on various hose and pipe couplings, for example, automotive radiator hose installations, etc., that illustrated being of the screw type which is adapted to be drawn down in clamping relation by turning the respective clamping screws 18c. Installation is completed by connecting the fitting 31 to a suitable pipe 19, of either flexible or rigid construction, which is adapted to supply water, under pressure, to the auxiliary pump structure.

Under normal conditions in which the main pump 3 is capable of handling all water entering the sump 1, the water level in the sump will be maintained below that necessary to raise the float 21, and the movable parts of the auxiliary pump 13 will be in the positions illustrated in FIG. 3, with the valve member 35 closing the nozzle 33, the weight of the float being applied to the valve member through the actuating member 38. It will be understood that, once the valve is in the position illustrated in FIG. 3, water pressure within the fitting 31 will normally maintain the valve member 35 in closed position.

However, should the water level in the sump rise to an abnormal height, for example as a result of loss of electrical power, or failure of the main pump 3, the float 21 will be raised to a position where the actuating member 38 will be pivoted to a point where the lever 43 thereof will move downwardly, engaging the adjacent portion of the valve member and draw the latter downwardly, to open the nozzle and permit water flow therethrough. As illustrated in FIGS. 3 and 5, the opening 44 in the valve member may be elongated to provide for a limited free travel of the arm 43 whereby a small amount of travel of the float 21 is necessary before it will move the valve member in opening direction.

During operation of the auxiliary pump 13 when the main pump 3 is not operating, the check valve 11 will prevent reverse flow of liquid through the pump 3. Likewise, during normal operation of the main pump 3 reverse flow downwardly through the venturi passage 24 is prevented by the check valve 61, 62.

Figure 7:
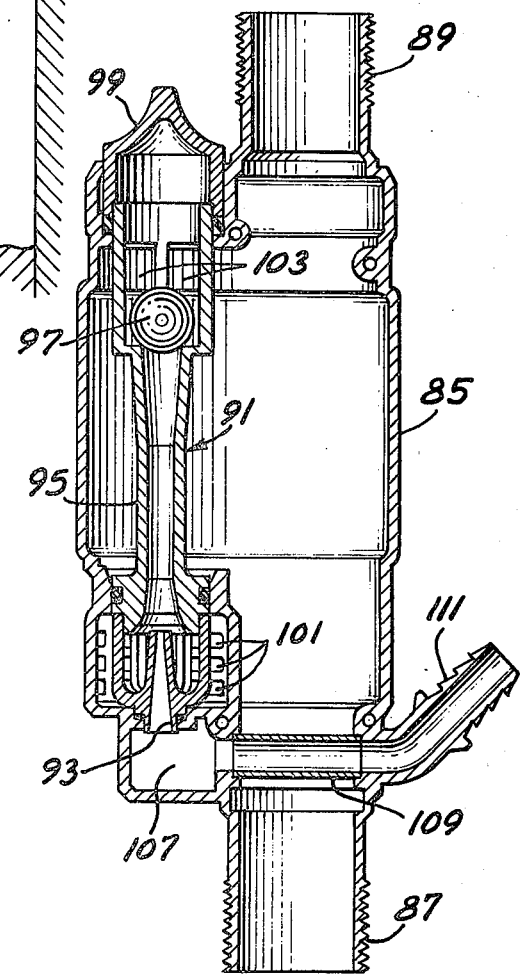
FIG. 7 is an enlarged sectional view taken along the longitudinal axis of the auxiliary sump pump of FIG. 6.

Next considering the second embodiment of the auxiliary sump pump of the present invention, illustrated in FIGS. 6 and 7, there is provided a main sump pump 75 and an auxiliary sump pump 77. The main sump pump 75 is generally similar to the main sump pump 3 described in connection with the first embodiment of the present invention, and comprises a submersible unit having an electric motor 79 which drives a pump 81. A discharge fitting 83 which houses a check valve (not shown) is attached to the pump 81, and the auxiliary sump pump 77 of the present invention is attached directly to the discharge fitting 83.

As best seen in FIG. 7, the auxiliary pump 77 comprises a hollow body 85 having an inlet fitting 87 and an outlet fitting 89. In the illustrated embodiment, the inlet and outlet fitting are male fittings having standard pipe threads. The auxiliary pump 77 is attached to the discharge fitting 83 of the main sump pump 75 buy a threaded connection.

The auxiliary pump 77 further comprises a jet pump 91 supported within the interior of the body 85. The jet pump 91 includes a nozzle 93, a venturi tube 95, a ball check 97, a cap 99, and outlet ports 103 disposed around the venturi tube above the ball check. The nozzle 93 of the jet pump 91 is in fluid communication with a water supply hose 105 through an inlet chamber 107, a stub tube 109 and a hose barb 111. Inlet ports 101 are provided in the wall of the body 85 adjacent the bottom end of the venturi tube 95.

A discharge pipe 113 is secured to the outlet fitting 89 of the auxiliary pump 77 by a threaded coupling 115. The discharge pipe 113 extends upwardly to a level at grade or above, outside the foundation or wall of the building wherein the sump is located (not shown).

The water supply hose 105 extends upwardly from its connection with the hose barb 111 to a water supply valve 114. The water supply valve 114 controls the admission of water under pressure into the auxiliary pump 77 from a water supply conduit or main 116. The water supply valve 114 is controlled by a float assembly 118 comprising a float 117 and a weight 119 both of which are secured to a float rod 121. The float rod 121 is suspended from an arm 123, the arm being pivoted about a pin or shaft 125 journalled in a bracket 127 attached to the body of the water supply valve 114.

A valve actuating stem 129 extends through the pivoted arm 123 on the opposite side of the pivot pin 125 from the float rod 121, and is secured to the arm by a knob 131. A coil spring 132 is provided between the end of the arm 123 and the bracket 127 which biases the arm 123 away from the bracket 127. The amount of biasing force which the spring exerts is adjustable by means of an adjusting screw 134.

The water supply valve 114 is a diaphragm type valve of standard construction, the details of which will not be shown or described because the particular construction of the valve 114 is not critical to an understanding of the teachings of the present invention. Any type of valve which is capable of controlling the flow of water and actuatable by a float mechanism may be used in accordance with the present invention.

In operation, the main sump pump 75 will ordinarily suffice to pump water from the sump. Means are provided (not illustrated) to automatically start the main pump 75 when the water level in the sump reaches a predetermined level, and to stop the pump 75 when the water level reaches a second predetermined level lower than the first level. Water or other liquid waste is discharged from the main pump 75 into the inlet fitting 87 of the auxiliary pump 77, and thence upwardly through the hollow interior of the body 85, to the discharge pipe 113. The ball check 97 of the jet pump 91 prevents the pumped fluid from flowing backwardly through the jet pump 91 in this mode of operation.

However, if for any reason the main pump 75 does not operate, or if the rate of accumulation of liquid in the sump exceeds the capacity of the main pump 75, the auxiliary pump 77 will be actuated. When the water level in the sump reaches a height sufficient to reach the float 117 and to buoy it upwardly with a predetermined force, the linkage between the float 117 and the valve actuating stem 129 causes the water supply valve 114 to open, thereby admitting water under pressure to the jet pump 91. The water flows through the hose barb 111, the stub tube 109, and the inlet chamber 107 into the nozzle 93. Water is discharged upwardly from the nozzle 93 at high velocity, into the throat of the venturi tube 95. A zone of decreased pressure is thereby produced at the throat of the venturi tube 95. The ball check 97 is readily moved upwardly by the upward flow of liquid to a position shown in dotted outline adjacent the cap 99 of the jet pump 91 (FIG. 7). The ejected water exits through the outlet ports 103 into the hollow interior of the body 85 and thence upwardly to the discharge pipe 113. In this mode of operation the check valve (not illustrated) disposed in the discharge fitting 83 of the main pump 75 prevents the flow of pumped liquid downwardly through the main pump 75.

When the level of water in the sump is lowered to a position where the float 117 is no longer buoyed by the liquid, the weight 119 causes the arm 123 to return to a position whereat the valve actuating stem 129 moves upwardly, thereby causing the water supply valve 114 to close.

The design of the various component parts of the auxiliary pump 77 is such that they can readily be molded from plastic material, thereby decreasing the cost of manufacture and permitting assembly of the auxiliary pump 77 by solvent welding or the like. A particular advantage of the embodiment illustrated in FIGS. 6 and 7 is that the auxiliary pump 77 can be installed simply by attachment to the discharge fitting 83 of the main pump 75, and the discharge pipe 113 then attached to the pump 77, eliminating the necessity of drilling a hole in the discharge pipe, as required in the embodiment illustrated in FIGS. 1 through 5.

Various modifications, obvious to those skilled in the art, can be made in the design and construction of the auxiliary sump pump of the present invention without departing from the spirit of the present invention. For example, the pump need not be constructed from plastic materials, but can also be made from steel and other metallic materials.

Various of the features of the present invention are set forth in the following claims.

What is claimed is:

1. An auxiliary water jet sump pump to supplement an electrical sump pump connected to a vertically extending discharge conduit, said water jet sump pump comprising a hollow body section having a connection to said discharge conduit, a vertically extending venturi passageway located within said body section, means for positioning said venturi passageway parallel to said discharge conduit and transversely spaced therefrom, the lower end of said venturi passageway being in fluid communication with a nozzle disposed in axial alignment with said venturi passageway, a valve for admitting water to said nozzle in response to a preselected fluid level in the sump, and a check valve in the upper part of said body section, the upper end of said venturi passageway being in fluid communication with said check valve and being in fluid communication with the conduit through said check valve, and said body section being in fluid communication with said electrical sump pump at its lower end and in fluid communication with said discharge conduit at its upper end.

2. The sump pump of claim 1 wherein said valve for admitting water to said nozzle is actuated by a float positioned in the sump.

3. The sump pump of claim 1 wherein a second check valve is disposed between said body section and said electrical sump pump.

4. An automatic auxiliary jet sump pump, particularly for use with a conventional electrical sump pump or the like, as a substitute pump in the event the conventional pump is inoperative, or as a supplemental pump in the event the conventional pump is incapable of handling all water thereat, comprising a body structure having a pair of vertically disposed pipe-engageable members respectively defining an upper chamber and a lower chamber, and having a venturi passageway therein connecting said upper and lower chambers, a nozzle in said lower chamber disposed to discharge water into said venturi passageway for aspirating water in said lower chamber into the upper chamber, means forming a water inlet communicating with said nozzle for supplying water under pressure thereto, valve means, including an actuating member extending externally of the body structure for selectively preventing water flow through said nozzle, a check valve in said upper chamber preventing reverse flow of water through said venturi passageway, float means operatively connected to said actuating member for opening said nozzle valve means upon predetermined upward movement of said float means, the lower pipe-engageable member having an inlet opening therein for the passage of water from the exterior into said lower chamber, the upper pipe-engageable member having a discharge opening therein adapted to operatively connect the chamber therein with the interior of a pipe, means for effecting a sealed joint between the upper member and such a pipe, and means for securing the upper member thereto, said actuating member comprising an integral rod member having a generally U-shaped portion comprising a pair of parallel leg portions connected at one corresponding end of each leg portion by an intermediate portion, one of said leg portions being mounted on said body structure for rotary movement relative thereto, a lever extending from the inner end of such leg portion transverse to the axis of the leg portion, with its free end operatively connected to the valve member for actuating the valve member, the free end of the other leg portion having an actuating arm extending transverse to the axis of the other leg portion in a direction opposite to that of said actuating lever, the free end of said actuating arm being connected to said float means for actuating thereby, and pivotally movable means connecting said body structure and said float means for guiding the float means with respect to the body structure.

5. A pump according to claim 4, wherein said mounted leg portion extending through packing chamber, in said body structure, in which is disposed packing material, and an O-ring on said leg portion engageable with an adjacent portion of the body structure, forming the initial seal therebetween.

6. A pump according to claim 5, wherein said pump-securing means comprises a clamping band adapted to encircle said upper member and such a pipe, and having means for placing said band under tension.

7. A pump according to claim 6, comprising an additional like clamping band which is adapted to encircle said lower member and such a pipe.

8. A pump according to claim 7, wherein said float-guiding means comprises a U-shaped bail member having its intermediate portion supported by said body structure for rotative mounting, and its leg portions operatively engaged with said float means.

9. A pump according to claim 8, wherein the legs of said bail member are approximately the same length as said actuating arm and generally disposed in parallel relation with respect thereto, said float means comprising a float member which is generally C-shaped in transverse section, with said float member partially encircling the body structure.

10. A pump according to claim 9, wherein the body structure of said pump is constructed of a plurality of plastic sections having abutting edges joined together in sealed relation.

11. A pump according to claim 4, wherein said pump-securing means comprises a clamping band adapted to encircle said upper member and such a pipe, and having means for placing said band under tension.

12. A pump according to claim 11, comprising an additional like clamping band which is adapted to encircle said lower member and such a pipe.

13. A pump according to claim 4, wherein said float-guiding means comprises a U-shaped bail member having its intermediate portion supported by said body structure for rotative mounting, and its leg portions operatively engaged with said float means.

14. A pump according to claim 13, wherein the legs of said bail member are approximately the same length as said actuating arm and generally disposed in parallel relation with respect thereto, said float means comprising a float member which is generally C-shaped in transverse section, with said float member partially encircling the body structure.

* * * * *